US006236287B1

(12) United States Patent
Quan et al.

(10) Patent No.: US 6,236,287 B1
(45) Date of Patent: May 22, 2001

(54) WIDEBAND SHIELDED COAXIAL TO MICROSTRIP ORTHOGONAL LAUNCHER USING DISTRIBUTED DISCONTINUITIES

(75) Inventors: Clifton Quan, Arcadia, CA (US); Edward L. Robertson, Atlanta, GA (US); Rosie M. Jorgenson, Norwalk, CA (US); Mark Y. Hashimoto, Torrance, CA (US); David E. Roberts, San Pedro, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/310,525

(22) Filed: May 12, 1999

(51) Int. Cl.[7] ..... H01P 1/04
(52) U.S. Cl. ..... 333/33; 333/260
(58) Field of Search ..... 333/260, 33

(56) References Cited

U.S. PATENT DOCUMENTS 5,872,550 2/1999 Quan et al. ..... 343/905
5,886,590 * 3/1999 Quan et al. ..... 333/260

* cited by examiner

*Primary Examiner*—Justin P. Bettendorf

(74) *Attorney, Agent, or Firm*—Leonard A. Alkov; Glenn H. Lenzen, Jr.

(57) ABSTRACT

A coaxial-to-microstrip vertical transition includes a dielectric substrate having formed on a first surface thereof a primary microstrip conductor trace, and on a second surface a secondary microstrip conductor trace. A first conductive via extends through the dielectric substrate and electrically connects the primary conductor trace to the secondary conductor trace. A second conductive via is spaced from the first conductive via and extends through the dielectric substrate to electrically connect the secondary conductor trace to the coaxial center conductor. A bottom microstrip ground plane layer is defined on the second substrate surface. A conductive base plate structure has a cavity formed therein, the substrate positioned such that the base plate structure is in contact with the bottom ground plane layer, and the secondary conductor trace is positioned over the cavity. The substrate is positioned between a cover structure and the base plate structure, the cover structure disposed in spaced relation with respect to the first surface of the substrate. A coaxial transmission line structure includes an outer shield and a coaxial center conductor structure disposed within the outer conductor and transverse to the substrate, the center conductor passed through an opening in the cover structure to contact the second via. A conductive plate structure is positioned between the plane of the cover structure and the substrate, providing shielding surrounding the center conductor between the cover and the substrate.

13 Claims, 3 Drawing Sheets

WIDEBAND SHIELDED COAXIAL TO MICROSTRIP ORTHOGONAL LAUNCHER USING DISTRIBUTED DISCONTINUITIES

TECHNICAL FIELD OF THE INVENTION

This invention relates to RF devices, and more particularly to a shielded coaxial to microstrip orthogonal launcher with multiple matching junctions for wideband microwave frequency operation with improved shielding and flexible routing of RF signals along the transmission line.

BACKGROUND OF THE INVENTION

There is a need in many RF systems to provide an orthogonal transition from a microstrip transmission line to a coaxial transmission line. A known technique of accomplishing this is to end launch a right angle coax connector onto microstrip along the substrate edge. Disadvantages of this approach include the relatively large space and volume requirements, and the requirement that the transition be made at the edge of the substrate.

It would therefore be an advantage to provide a transition technique which required less space, and offered the flexibility to vertically launch anywhere along the microstrip circuit board.

Another problem not addressed by known transition techniques between coaxial and microstrip transmission lines involves the issue of complete ground shielding the coaxial launcher as it contacts the microstrip center conductor vertically from an air dielectric side. In known techniques, the coaxial outer ground shield is partially removed to prevent that shield from short circuiting the microstrip center conductor. Exposing the coaxial section to air will result in RF leakage and the generation of the higher order waveguide modes, and thus degrades the RF performance when used at higher frequencies. Commercially available coaxial launchers are thus limited at the high frequency end to about 7 Ghz. Launchers for channelized microstrip transmission line described in U.S. Pat. No. 5,416,453 are limited at the high frequency end to about 14 Ghz.

SUMMARY OF THE INVENTION

A coaxial-to-microstrip vertical transition in accordance with this invention can operate at higher frequencies with better RF performance than what has been accomplished in the past. A coaxial-to-microstrip transition in accordance with an aspect of this invention is completely shielded with little possibility of leakage or generation of higher order waveguide modes at higher frequency. The transition incorporates matching junctions for improved performance, and a compressible center conductor to allow for blind mate connections.

In an exemplary embodiment, the coaxial-to-microstrip vertical transition includes a dielectric substrate having formed on a first surface thereof a primary microstrip conductor trace, and on a second surface a secondary microstrip conductor trace. A first conductive via extends through the dielectric substrate and electrically connects the primary conductor trace to the secondary conductor trace. A second conductive via is spaced from the first conductive via and extends through the dielectric substrate to electrically connect the secondary conductor trace to the coaxial center conductor. A bottom microstrip ground plane layer is defined on the second substrate surface. A conductive base plate structure has a cavity formed therein, the substrate positioned relative to the base plate structure such that the base plate structure is in contact with the bottom ground plane layer, and the secondary conductor trace is positioned over the cavity so that the secondary conductor is not in electrical contact with the base plate structure. A conductive cover structure is disposed such that the substrate is positioned between the cover structure and the base plate structure, the cover structure disposed in spaced relation with respect to the first surface of the substrate. The transition further includes a coaxial transmission line structure having an outer shield, a coaxial center conductor structure disposed within the outer conductor and transverse to the substrate, the center conductor passed through an opening in the cover structure to contact the second via. A conductive plate has an opening formed therein, and is positioned between the cover structure and the substrate, the plate providing shielding surrounding the center conductor in a space between the cover and the substrate.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
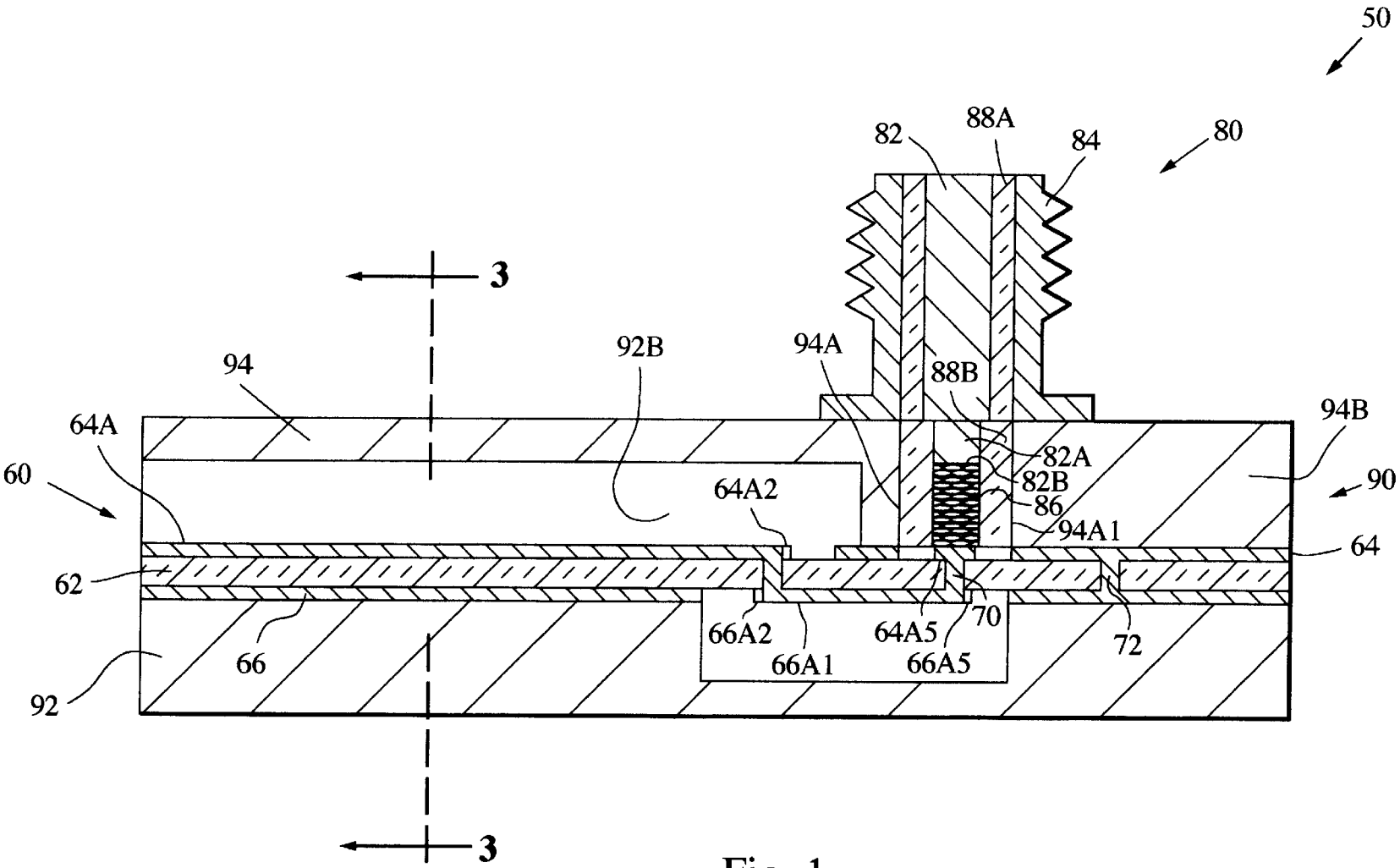
FIG. 1 is a cross-sectional diagram illustrating a coaxial-to-microstrip transmission line transition in accordance with the invention.

A coaxial-to-microstrip vertical transition 50 is illustrated in cross-section in FIG. 1. The transition is capable of operation from DC to 18 Ghz with low loss and excellent match. The microstrip transmission line 60 is provided by a dielectric substrate 62 having on an upper surface thereof a conductive layer pattern 64 defining a primary microstrip conductor 64A, and on a lower surface thereof a bottom microstrip conductive layer pattern 66. The relative thicknesses of the conductive layer patterns 64 and 66 in relation to the substrate thickness are exaggerated in the figures for illustrative purposes. In a typical implementation, the conductive layer patterns will be relatively thin, the patterns being defined by photolithographic techniques as is well known in the art.

The coaxial transmission line 80 in this exemplary embodiment includes a solid metal center conductor 82 disposed within an outer cylindrical conductor shield 84. The outer periphery of the shield 84 is threaded in this embodiment to form a coaxial connector, to which a matching coaxial connector can be connected to make connection to a coaxial line.

In this exemplary embodiment, the microstrip circuit board comprising the substrate 62, primary conductor 64 and ground plane 66 is installed in a metal housing 90 comprising a base plate 92 and a metal cover 94. The base plate 92 has an air dielectric cavity 92A formed therein in a region underlying the transition. The cover has a circular bore 94A formed therein to receive the coaxial transition elements. A second air dielectric cavity 92B is formed in the region between the substrate and the cover. A metal plate portion 94B is disposed between the plate 92 and cover 94. The metal plate portion 94B has formed therein the cavity or bore 94A, to form a shielded coaxial outer conductor in the region between the circuit board substrate and the plane of the cover plate. In this exemplary embodiment, the metal plate portion 94B is formed as an integral structure with the cover 94, although in another embodiment, the metal plate portion can be fabricated as a separate structure from the cover.

Figure 2A:
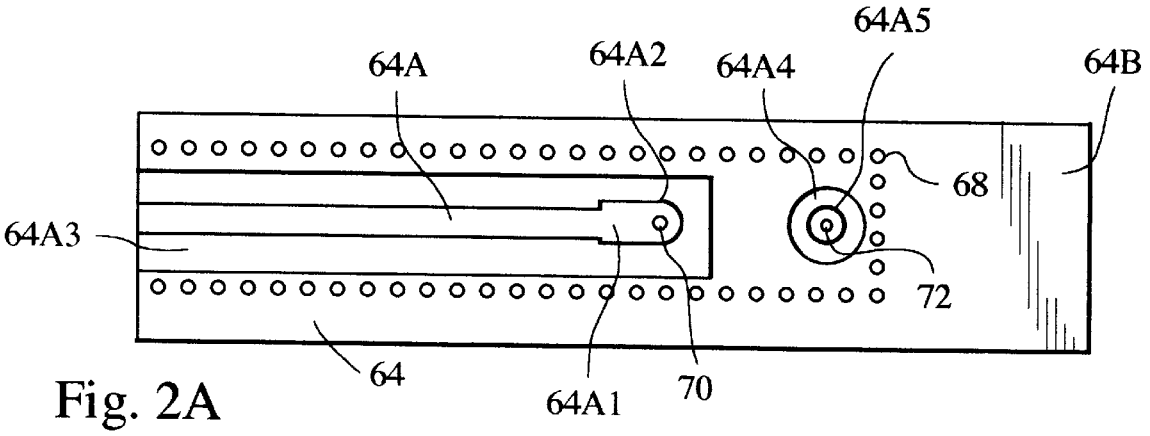
FIG. 2A is a top view of the top microstrip conductive layer pattern of the microstrip circuit board of the transition of FIG. 1.
Figure 2B:
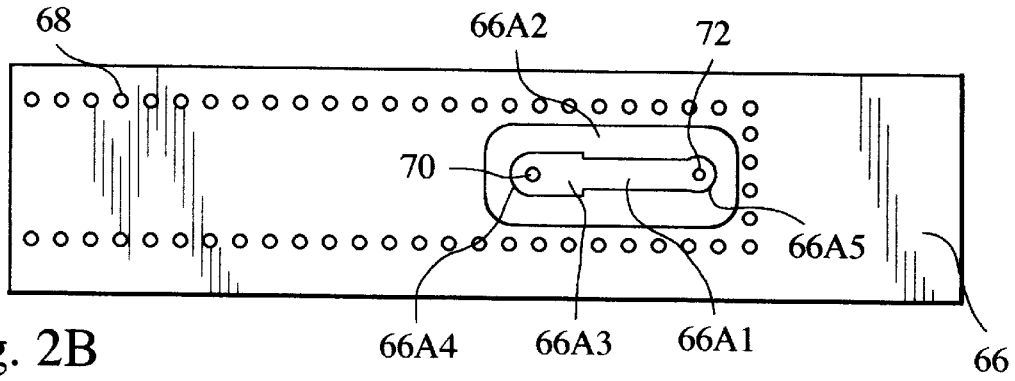
FIG. 2B is a bottom view of the bottom microstrip conductive layer pattern of the circuit board.

The top microstrip conductive layer pattern 64 is illustrated in FIG. 2A, and the bottom layer pattern 66 is illustrated in FIG. 2B. The top layer pattern 64 defines the primary microstrip conductor line 64A, which ends in a widened region 64A1 and a microstrip pad 64A2 for impedance matching. Region 64A3 is a clearout area in which the conductive layer is removed from the top surface of the substrate. The top layer pattern 64 further defines a top ground plane 64B which extends about the primary conductor line 64A and the clearout region 64A3. Another clearout region 64A4 surrounds a connecting via 64A5. Ground vias 68 extend through the substrate between the top layer pattern and bottom layer pattern.

As shown in FIG. 2B, the bottom layer pattern 66 defines the microstrip ground plane, provides a termination for the ground vias 68, and defines a secondary microstrip transmission line 66A1. A clearout region 66A2 surrounds the secondary line 66A1. The secondary line 66A1 is widened at region 66A3 where the top and bottom cavities 92A and 92B (FIG. 1) overlap, to provide impedance matching. A connecting via 70 runs through the substrate between pad 66A4 and pad 66A2 (FIG. 2A), to electrically connect the primary and secondary microstrip conductors. A conductive via 72 runs through the substrate, from pad 66A5 to pad 64A5 (FIG. 2A) in the top conductive layer pattern 64, for connection between the secondary microstrip conductor and the interconnect structure 86 (FIG. 1) for the coaxial center conductor.

The space between the center conductor 82 and the outer shield 84 is filled by a dielectric spacer 88A, which is a material such as TEFLON(™), for example.

The diameter of the center conductor 82 is stepped down from its diameter in the coaxial shield 84 to a smaller diameter at the plane of the top surface of the cover 94, to improve the impedance match to the pad. The smaller diameter portion 82A has a length equal to the thickness of the cover 94 in this exemplary embodiment. A compressible conductive interconnect structure 86 extends between the tip 82B of the conductor 82 and the conductive pad 64A5 formed by the top conductor layer pattern 64. The compressible interconnect structure 86 in this exemplary embodiment is a bundle of thin, densely-packed gold-plated wire. Other interconnect structures can alternatively be employed, e.g. a conductive bellows structure which is compressible, or a solid conductor which has a spring-loaded telescoping conductor pin extending from one end. Alternatively the coaxial center conductor tip can simply extend to the substrate pad, instead of using a compressible interconnect. This will result in more risk in creating a gap between the tip and the pad, due to manufacturing tolerances.

A dielectric spacer structure 88B fills the cavity space between tip region 82/interconnect 86 and the walls 94A1 of the plate 94. This structure can also be fabricated of TEFLON(™) or other suitable dielectric material. The structure 88B has formed therein a central bore which receives the tip 82A and the interconnect structure 86.

The transition structure 50 operates in the following manner. The coaxial center conductor 82 through the interconnect structure 86 contacts the pad 64A5 (FIG. 2A) on the circuit board which is connected to the secondary or "transition" microstrip center conductor 66A1 with a plated through hole formed in the substrate, defining the connecting via 72. This transition or secondary microstrip line 66A1 is located on the one (bottom) side of the circuit board while the main or primary microstrip line comprising primary conductor 64A is located on the opposite (top) side. The secondary microstrip line is then connected to the main microstrip by another plated through hole extending through the substrate defining the connecting via 70. The corresponding groundplane for the primary and secondary microstrip lines are also connected by a series of plated through holes (ground vias 68).

At the connecting vias 70, 72, the diameter of the microstrip pads 64A2, 64A5 is designed to cancel out parasitic inductance contributed by the respective plated through vias. Also, the traces of both the primary and secondary microstrip conductor lines are intentionally widened at respective regions 64A1, 66A3 to assure continuous 50 ohm characteristic impedance when the two lines enter the region where their respective air cavities 92B, 92A overlap.

Figure 3:
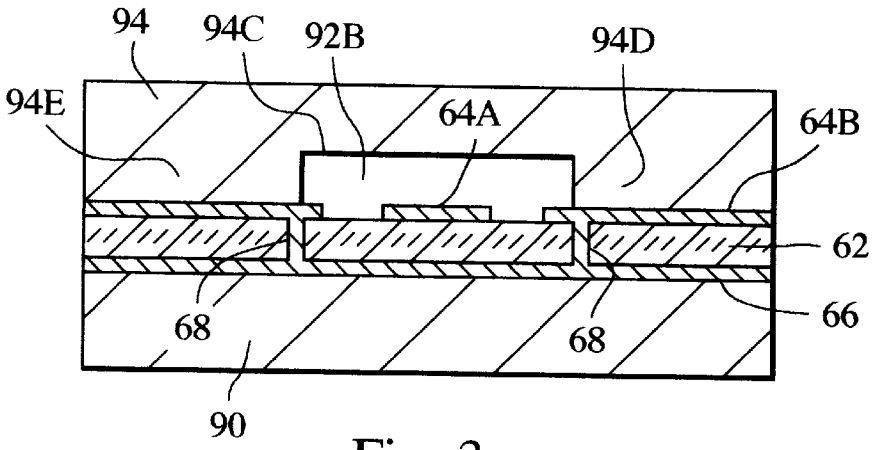
FIG. 3 is an end cross-section view showing how the microstrip transmission line is "quasi-channeled" to control RF leakage and prevent the generation of higher order modes.

The microstrip transmission line used in this invention is "quasi-channeled" as illustrated in the end cross-section view of FIG. 3 to control RF leakage and prevent the generation of higher order modes. Thus, the cover 94 has a channel 94C which defines the air channel 92B, and side regions 94D, 94E which contact the upper ground plane regions 64B. The circuit board 62 remains continuous at the sides beyond the air channel 92B to preserve the board's stiffness and avoid the cost of board cutting along the channel route. Ground connection between the top cover 94, the base plate 90 and the ground planes 64B and 66 is accomplished through the use of ground vias 68 when the assembly is clamped together with screws (not shown).

The center conductor contact of the coaxial line onto the microstrip pad can use either a "hard" contact (such as a solder or conductive epoxy) or use a compressible center such as densely packed wire bundles (fuzz buttons), bellows or pogo pins. The use of the compressible center allows for re-usable blindmate connections.

The outer conductor ground shield formed by the metal plate portion 94B is fabricated as an integral structure with the top cover 94. The outer conductor of the coaxial transition is continuous with no cutouts or opening when it contacts the top ground plane of the secondary microstrip transition line. This metal ground contact can be accomplished by either pressure with or without the addition of RF gaskets to prevent RF leakage. Another method to realize a continuous metal ground contact between the coax and microstrip is with either conductive epoxy or solders.

Figure 4A:
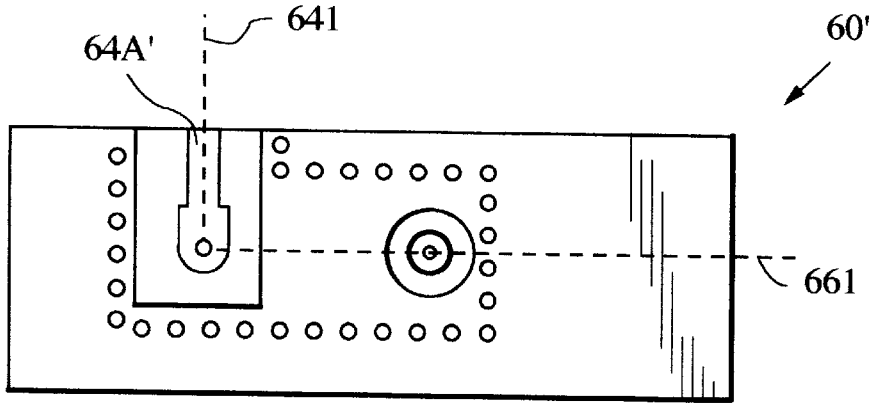
FIG. 4A is a top view of a portion of an alternate embodiment of a transition substrate embodying the invention.
Figure 4B:
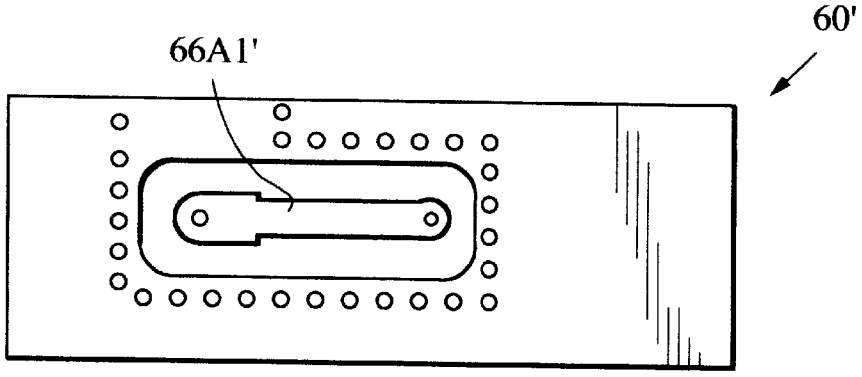
FIG. 4B is a bottom view of this substrate.

Two connecting vias 70, 72 transition the coaxial line to the primary microstrip without the need to open the outer conductor of the coaxial line, which would result in RF leakage into the air dielectric of the primary microstrip transmission line. These connecting vias are separated by the secondary microstrip line 66A1 at a distance designed to assure negligible mismatch interactions. The two connecting vias utilized in this invention allows additional degrees of freedom for routing since the primary and secondary microstrip lines do not necessarily have to be connected in a straight line but can run at varying angles with respect to each other along the circuit board as illustrated in FIGS. 4A and 4B. FIG. 4A illustrates the top surface of an alternate embodiment of a circuit board 60' comprising a transition in accordance with the invention, and FIG. 4B the bottom surface of the circuit board. Here, the primary microstrip conductor 64A' extends along a linear axis 641, and the secondary microstrip conductor 66A1' extends along an axis 661. In this exemplary embodiment, the primary line axis 641 extends at a 90 degree angle with respect to the secondary line axis 661, although the angle need not be a right angle.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A coaxial-to-microstrip vertical transition, comprising:

a dielectric substrate having formed on a first surface thereof a primary microstrip conductor, and on a second surface a secondary microstrip conductor, wherein the primary microstrip conductor extends along a first linear axis, and the secondary microstrip conductor extends along a second linear axis, and wherein the first linear axis is not parallel to the second linear axis, such that the secondary microstrip conductor extends at an angle with respect to the primary microstrip conductor;

a first conductive via extending through the dielectric substrate and electrically connecting the primary conductor to the secondary conductor;

second conductive via spaced from the first conductive via and extending through the dielectric substrate to electrically connect the secondary conductor to a coaxial center conductor;

a bottom microstrip ground plane layer defined on said second substrate surface;

a conductive base plate structure having a cavity formed therein, the substrate positioned relative to the base plate structure such that the base plate structure is in contact with the bottom ground plane layer, and the secondary conductor is positioned over the cavity so that the secondary conductor is not in electrical contact with the base plate structure;

a conductive cover structure disposed such that the substrate is positioned between the cover structure and the base plate structure, the cover structure disposed in spaced relation with respect to the first surface of the substrate; and a coaxial transmission line structure having an outer shield, said coaxial center conductor disposed within the outer conductor and transverse to the substrate, the coaxial center conductor passing through an opening in the cover structure to contact the second via.

2. The transition of claim 1, further comprising a conductive plate structure having an opening formed therein and positioned next to the cover structure, the plate providing shielding surrounding the coaxial center conductor in a space between the cover and the substrate.

3. The transition of claim 1 wherein the conductive cover structure has a channel defined therein, the channel defining a cavity through which the primary microstrip conductor extends, with conductive sidewalls providing side shielding of a primary microstrip transmission line comprising the primary microstrip conductor.

4. The transition of claim 1, wherein the coaxial center conductor includes a rigid solid conductor portion and a compressible contact structure positioned between a tip of the rigid solid center conductor portion and the second via.

5. The transition of claim 1, further comprising a plurality of conductive ground vias extending through the substrate between the first and second surfaces, the plurality of conductive ground vias positioned so as to contact the base plate structure and the cover structure.

6. The transition of claim 1, further comprising a contact pad formed on the first surface of the substrate in electrical contact with the second via, the center conductor structure in electrical contact with the first contact pad.

7. The transition of claim 1, wherein a portion of the outer shield of the coaxial transmission line structure extending from the cover structure is threaded.

8. The transition of claim 1 wherein the coaxial transmission line structure further includes a dielectric sleeve disposed in a space between the cover structure and the substrate, the sleeve surrounding the tip region of the center conductor.

9. The transition of claim 8 wherein the coaxial center conductor includes a compressible conductive contact structure disposed within the sleeve structure and positioned between the tip region and the second via.

10. A coaxial-to-microstrip vertical transition, comprising:

a dielectric substrate having formed on a first surface thereof a primary microstrip conductor, and on a second surface a secondary microstrip conductor;

a first conductive via extending through the dielectric substrate and electrically connecting the primary conductor to the secondary conductor;

a second conductive via spaced from the first conductive via and extending through the dielectric substrate to electrically connect the secondary conductor to a coaxial center conductor;

a bottom microstrip ground plane layer defined on said second substrate surface;

a conductive base plate structure having a cavity formed therein, the substrate positioned relative to the base plate structure such that the base plate structure is in contact with the bottom ground plane layer, and the secondary conductor is positioned over the cavity so that the secondary conductor is not in electrical contact with the base plate structure;

a conductive cover structure disposed such that the substrate is positioned between the cover structure and the base plate structure, the cover structure disposed in spaced relation with respect to the first surface of the substrate so that an air cavity is defined about the primary microstrip conductor;

a coaxial transmission line structure having an outer conductor, said coaxial center conductor disposed within the outer conductor and transverse to the substrate, the center conductor structure passing through an opening in the cover structure to contact the second via, the center conductor structure including a rigid solid conductor portion and a compressible contact structure positioned between a tip of the rigid solid center conductor portion and the second via; and a conductive plate structure having an opening formed therein and positioned next to the cover structure, the plate providing shielding surrounding the center conductor in a space between the cover and the substrate.

11. The transition of claim 10, further comprising a plurality of conductive ground vias extending through the substrate between the first and second surfaces, the plurality of conductive ground vias positioned so as to contact the base plate structure and the cover structure.

12. The transition of claim 10, further comprising a contact pad formed on the first surface of the substrate in electrical contact with the second via, the center conductor structure in electrical contact with the first contact pad.

13. The transition of claim 10 wherein the primary microstrip conductor is parallel to the secondary microstrip conductor.

* * * * *